US011980239B1

(12) United States Patent
Coda

(10) Patent No.: US 11,980,239 B1
(45) Date of Patent: May 14, 2024

(54) MOISTURE RETAINING ARTICLE OF APPAREL

(71) Applicant: Kristin Coda, Mountain Lakes, NJ (US)

(72) Inventor: Kristin Coda, Mountain Lakes, NJ (US)

( * ) Notice: Subject to any disclaimer, the term of this patent is extended or adjusted under 35 U.S.C. 154(b) by 73 days.

(21) Appl. No.: 17/929,948

(22) Filed: Sep. 6, 2022

Related U.S. Application Data

(60) Provisional application No. 63/240,468, filed on Sep. 3, 2021.

(51) Int. Cl.
*A41D 19/00* (2006.01)

(52) U.S. Cl.
CPC ..... *A41D 19/0082* (2013.01); *A41D 19/0006* (2013.01)

(58) Field of Classification Search
CPC ..... A41D 19/0006; A41D 19/01517; A41D 19/0013; A41D 19/0017; A41D 19/0082
See application file for complete search history.

(56) References Cited

U.S. PATENT DOCUMENTS 1,358,823 A * 11/1920 Burden ..... A41D 19/015 2/21
5,963,985 A * 10/1999 Behr ..... A41D 13/087 2/21
6,032,290 A * 3/2000 Lucas ..... A41D 19/00 2/21
6,684,406 B2 * 2/2004 Fowler ..... A41D 13/084 2/21
6,839,905 B1 * 1/2005 Bruder ..... A41D 13/087 2/21
7,210,172 B2 * 5/2007 Adams, Jr. ..... A63B 21/4025 2/21
7,251,836 B2 * 8/2007 Santiago ..... A41D 13/087 2/21
8,209,775 B2 * 7/2012 Makis ..... A63B 71/141 2/163
8,313,471 B2 * 11/2012 Hendricks ..... A41D 19/0017 2/21
11,684,099 B2 * 6/2023 Shaikh ..... A41D 19/01535 2/160
2007/0118947 A1 * 5/2007 Lorenzo ..... B42D 9/04 2/21

(Continued)

FOREIGN PATENT DOCUMENTS

JP 3187293 U * 11/2013

*Primary Examiner* — Tajash D Patel
(74) *Attorney, Agent, or Firm* — Lathrop GPM LLP; Ricardo Ochoa

(57) ABSTRACT

A multi-layer material system used to form various products that encourages moist substances or medications to stay on and penetrate a person's skin for moisturizing benefits and protection, as well as for medical treatment. The system enables a degree of outward vapor and air flow while preventing bulk transfer of the moist substances. Simultaneously, the system provides resistance to, and protection from, external elements including one or more of heat, ultraviolet radiation and mechanical abrasion. One such product is a glove formed of the material system and having articulatable closed ends at each digit for enabling selective exposure of a respective fingertip and nail.

10 Claims, 8 Drawing Sheets

(56) References Cited

U.S. PATENT DOCUMENTS

| | | | | |
|---|---|---|---|---|
| 2013/0281243 | A1* | 10/2013 | Wenthen | F16H 3/72 475/5 |
| 2015/0289575 | A1* | 10/2015 | Krautner | A41D 19/0017 2/163 |
| 2016/0081404 | A1* | 3/2016 | Visokey | A41D 13/087 2/21 |
| 2017/0239553 | A1* | 8/2017 | Kowalsky | A41D 19/01558 |

* cited by examiner

MOISTURE RETAINING ARTICLE OF APPAREL

RELATED APPLICATIONS

This application claims priority to U.S. provisional Application No. 63/240,468 filed Sep. 3, 2021, the content of which is incorporated herein by reference in its entirety.

BACKGROUND

To address dry skin, particularly dry hands, many people apply moisturizers, such as lotions, creams, oils, ointments, and in severe cases, medicine to their hands. However, since the skin is exposed to so many different materials and environments, it becomes difficult to keep the moisture-like substance in contact with the skin long enough to penetrate the skin for optimal results and effectiveness.

One solution for a person's hands is the use of gloves. Typically, a user will put lotion or cream on their hands and then put gloves on to keep the moisture on their hands, any time or often overnight while sleeping. However, many, if not most, of these gloves consist of cotton or other absorbent or partially absorbent materials. They can be ineffective as they absorb a good amount of the moisture intended for the skin. Other types of gloves used are made of heavy fabric and can cause the user's hands to get hot and sweaty because they prevent airflow, and the material is not breathable.

In addition, since most gloves that aim to "moisturize" the skin are closed around the fingers (like traditional gloves), a user cannot perform many tasks, especially those requiring dexterity or fine motor skills. Generally, people simply cannot or struggle to hold pens, use tools, grasp small objects, or use a cell phone or computer when wearing gloves.

Other products that help users keep their skin soft, especially on the feet, include socks. Many of these socks also are made of cotton, and some have a gel lining for this purpose, similar to gloves. Cotton tends to absorb moisture-like substances, as previously stated. Gel socks keep the moisturizer against the skin, but they can make the feet hot and sweaty, just like gel gloves. And, just like the gloves, these types of socks prevent airflow, and the material is not breathable.

SUMMARY OF THE INVENTION

This disclosure relates to a material system for an article such as a glove that is dual purpose, particularly an article that combines multiple layers of specific materials enabling the article to perform in the following ways: (1) to lock in moisture such as lotions, oils, ointments, medicines, etc., so that these substances stay on and penetrate a person's skin, and (2) to protect from UV and LED light and heat. In addition, this disclosure relates to a material system that may be configured to provide similar beneficial functions with respect to body parts other than hands, including containing moisture against the skin of a user and protecting the underlying skin from the harmful effects of UV and LED lights. For example, the material system may be configured into foot coverings similar to socks and wraps for use various body extremities, such as wrists, ankles, heels, arms, legs, shoulders, knees, etc.

At least three material layers are utilized to achieve the presently disclosed material system. At a minimum, the material system is comprised of a stretchy, breathable fabric often used in sportswear, sport fashion, and other high-end apparel applications. This first layer sits on top of the skin. Another layer, consists of an external protective or shell layer, which is the outer layer of the system. Candidate materials for this layer include spandex, polyester, nylon, leather, rubber, vinyl, or a combination thereof. These two material layers are bonded together. However, prior to combining these layers to form a glove, sock or other product, an impermeable membrane layer comprising a polyurethane (PU) or modified PU coating is bonded to one side of the breathable fabric thereby forming the system's intermediate layer. This PU coated fabric side is then bonded to the outside of the inner breathable layer before the external protective or shell layer is added. Thus, a three-layer materials system is created as a single compound material comprising a breathable first layer that is adjacent to the skin of a user, a second, intermediate impermeable layer that provides a moisture and heat barrier, and a third, outer protective shell layer consisting of nylon, polyester, spandex, or similar.

DETAILED DESCRIPTION OF THE EMBODIMENTS

Embodiments here include a multi-layer material system that may be used to form various articles, items or products that enable moist substances or medications to stay on and penetrate a person's skin for moisturizing benefits and protection, as well as for medical treatment. Typically, the terms impermeable and non-porous mean the same thing: a substance with a solid surface with no pores. An impermeable or non-porous substance does not allow any other substances to penetrate its surface or breakthrough. However, it is possible for a material to be impervious to moisture while at the same time being breathable enabling air to flow thereacross. The references forthcoming may refer to the impermeability to moisture as "moisture-proof" and the ability to enable airflow as "breathable."

Figure 1:
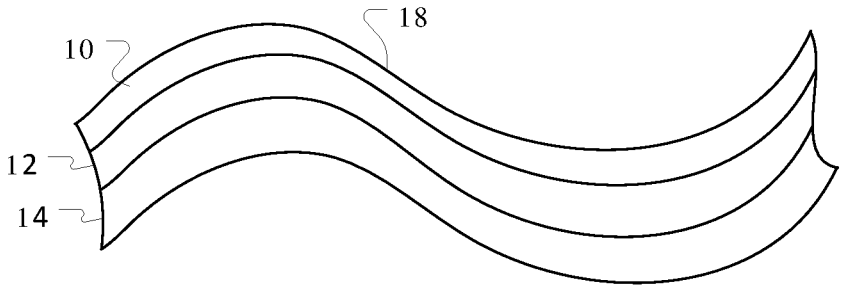
FIG. 1 shows a view of an embodiment of a material system for moisture retention.

FIG. 1 shows an embodiment of the material system from which gloves, socks, wraps, and other items of the embodiments can be made. This embodiment 18 of the material system has three layers, including an external protective or shell layer 10, that protects the user's skin from the external environment such as heat and radiation from UV and LED lights, a water impermeable but breathable intermediate layer and a water-repellant inner fabric layer 14. These are referred to here as layers because they are of different materials, even though they are bonded together according to techniques known in the art and so could be viewed as one compound layer.

The illustrated embodiment 18 has an external protective or shell layer 10, an intermediate impermeable but breathable membrane layer 12 and a water-repellant inner fabric layer 14. The external protective or shell layer may be provided of spandex, polyester, nylon, leather, rubber, vinyl, or a combination thereof, for example. Such material may provide mechanical strength.

Inside the external protective or shell layer 10 is a fabric membrane layer 14 that is hydrophobic and breathable. This breathable membrane layer may be provided as a knit fabric of hydrophobic nylon or polyester blended with spandex. The material system may further comprise an intermediate impermeable but breathable layer 12, comprised of a thin, hydrophobic non-porous monolithic membrane, shown in the embodiment 18 of FIG. 1. The impermeable layer 12 may be provided of a hydrophobic material such as modified polyurethane (PU) that enables liquid vapor to pass therethrough but blocks bulk liquid transfer. The hydrophobic nature of this layer further inhibits such liquid transfer. This impermeable layer beneficially provides UV and heat resistance in addition to presenting a further moisture barrier. The intermediate impermeable but breathable layer 12 may be applied to the fabric layer 14 according to techniques known in the art. Collectively, the fabric layer and the intermediate impermeable but breathable layer may be provided as GELANOTS® or similar membranes. The external protective or shell layer 10 is then applied to the outer exposed surface of the intermediate layer.

Water in liquids has very strong intermolecular forces that are greater than the attractive forces between water molecules and the PU of the intermediate impermeable but breathable layer 12. Liquid water thus cannot pass through the combined internal fabric layer 14 and PU membrane of the intermediate impermeable but breathable layer 12 because it takes a great deal of pressure to force it through openings between the molecules comprising the hydrophobic PU. This combined internal fabric layer and intermediate impermeable but breathable layer, in a first embodiment, has a thickness of 20 microns or less. The combined internal fabric layer 14 and PU membrane of the intermediate impermeable but breathable layer 12 is impervious to moisture but is capable of allowing water vapor and air to flow therethrough, particularly when the force created by the difference in partial pressure between the inside and outside of this combined material system and the elevated temperature on the inside of the combined material system layer pushes the vapor molecules outward. The hydrophobic nature of the impermeable but breathable layer encourages vapor transfer while still preventing bulk liquid transport. When configured as a wearable article such as a glove, this material system enables liquids such as moisturizers and medications to remain against the skin for extended periods since the liquids cannot be transported through the combined internal fabric layer 14 and PU membrane of the intermediate impermeable but breathable layer 12. It enables liquids to penetrate the skin better and more effectively than other materials such as cotton that would otherwise wick and absorb liquids away from the skin and facilitate evaporation.

Collectively, the combined internal fabric layer 14 and PU membrane of the intermediate impermeable but breathable layer 12 form a hydrophobic monolithic membrane. This membrane stops absorption and transport of liquids such as moisturizer, allowing the liquid to remain on the user's skin. However, once water comes into contact with the intermediate impermeable but breathable layer, individual water molecules are transported by solid-state diffusion outwards. Diffusion is a process by which a substance at a high concentration is transported to a region of lower concentration. Thus, individual water molecules in their liquid form travel as water vapor by the high concentration of moisture on the inner surface of the combined internal fabric layer 14 and PU membrane of the intermediate impermeable but breathable layer 12 and the low concentration of water on the outer surface thereof. Once the water molecule reaches the intermediate layer 12, it evaporates and is transported by gas phase diffusion through the PU membrane 12. This may alleviate issues with sweating of the user's hands, in the context of the disclosed material system being fashioned as a glove.

While the presently disclosed material systems, and in particular the three layer material system of FIG. 1, may be assembled in various steps, one illustrative method includes obtaining a quantity of knit fabric as the inner layer 14 material, and coating one side of the fabric layer material with polyurethane or modified polyurethane to create the impermeable but breathable layer 12. A quantity of the external protective or shell layer 10 material, such as spandex, polyester, nylon, leather, rubber, vinyl, etc., is then obtained and adhered to the impermeable or membrane layer material, opposite the fabric layer. Coloring and/or patterning steps may also be practiced as desired. The material system may then be cut into pieces of the desired article, which are then assembled using conventional techniques such as stitching or gluing.

While certain materials have been identified above for the external protective or shell layer 10, the impermeable but breathable layer 12 and the fabric layer 14, other materials providing the respective functions may be employed. Further, various treatments may be practiced in order to enhance the function of one or more of the layers. As an example, the external protective or shell layer may undergo a chemical treatment to enhance the UV resistance of that layer, particularly in the case in which the external protective or shell layer is provided of a material such as polyurethane that is otherwise susceptible to UV degradation. In alternative embodiments, polyurethane utilized in the intermediate impermeable but breathable layer 12 is at least partially shielded from UV light as a result of being applied to the interior surface of the external protective or shell layer 10 and therefore does not require such chemical treatment.

Figure 2:
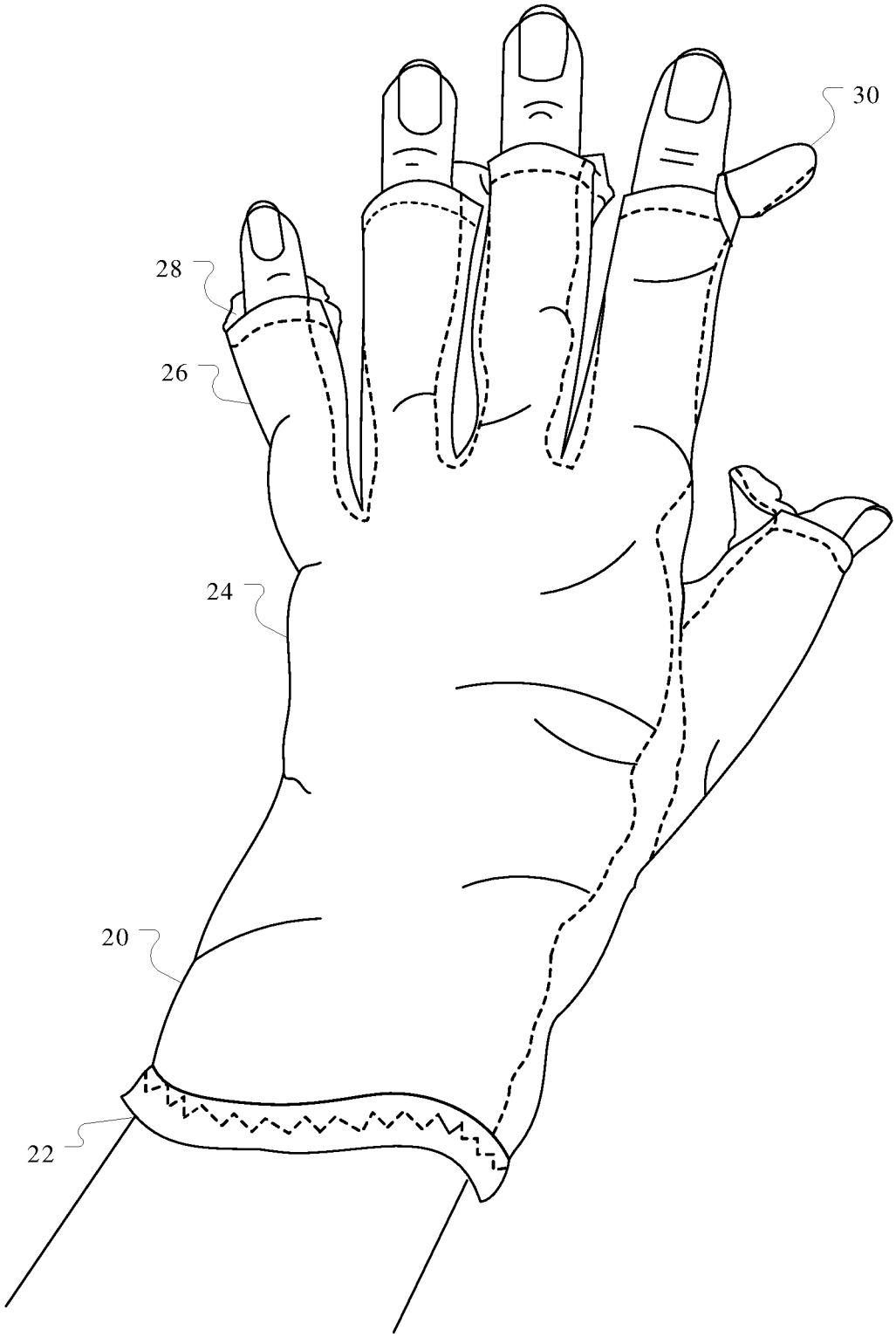
FIG. 2 shows a top view (back of hand) of an embodiment of a glove incorporating the material system of FIG. 1 with a user's fingers partially exposed.

Preferably, the materials employed in the disclosed material system are machine washable and dryable. The capability of the material to block heat and harmful UV rays may provide anti-aging benefits. The external protective or shell layer 10 material may be provided in different colors and patterns, with stitching, ruggedization, and other embellishments desired for gloves, socks, wraps, etc. For example, sublimation printing may be employed for the purpose of applying patterning or logos to the external protective or shell layer. The protective article, such as gloves, socks, or body wraps, may be made available in various sizes and different configurations. As a specific example, gloves such as shown in FIG. 2 may be specifically configured for use as driving gloves. Such driving gloves enable a user to benefit from extended exposure to moisture, medication, or other moist substances. The driving gloves may be provided with patterned materials such as silicone on the fingers and/or palm that enhance the user's grip on a steering wheel. Further, such driving gloves may provide thermal protection from steering wheels and other surfaces that may be at elevated temperatures if the respective vehicle has been parked in a hot weather climate.

FIG. 2 shows an embodiment of a glove 20 comprised of the presently disclosed material system of FIG. 1. The glove has a body 24 that corresponds to the palm and back of the user's hand. The glove 20 has finger portions or protrusions 26 having closed ends 30. The protrusions 26 connect to the glove body 24 to allow insertion of the user's fingers and thumb. The protrusions 26 and the glove body 24 have a top surface oriented to correspond to the back of an inserted hand and a bottom surface oriented to the palm of an inserted hand.

In a first embodiment, each protrusion 26 has an opening 28 near the top surface of the respective protrusion. The openings 28 are positioned proximate to and above the distal finger joint, between the closed ends 30 and the glove body 24, and are positioned to allow the closed ends 30 to be pulled off the distal end of the respective finger or thumb while remaining part of the glove, to allow access to the fingertip and/or fingernail on one or more of the fingers and the thumb. The protrusions may be thought of as having a distal end, including the closed ends, and a proximal end, closer to and adjoining the glove body. In an alternative embodiment (not illustrated), each protrusion 26 has an opening 28 in the bottom surface of the respective protrusion. In yet a further embodiment (also not illustrated), each protrusion has an opening in at least a portion of a peripheral surface of the respective protrusion.

Figure 3:
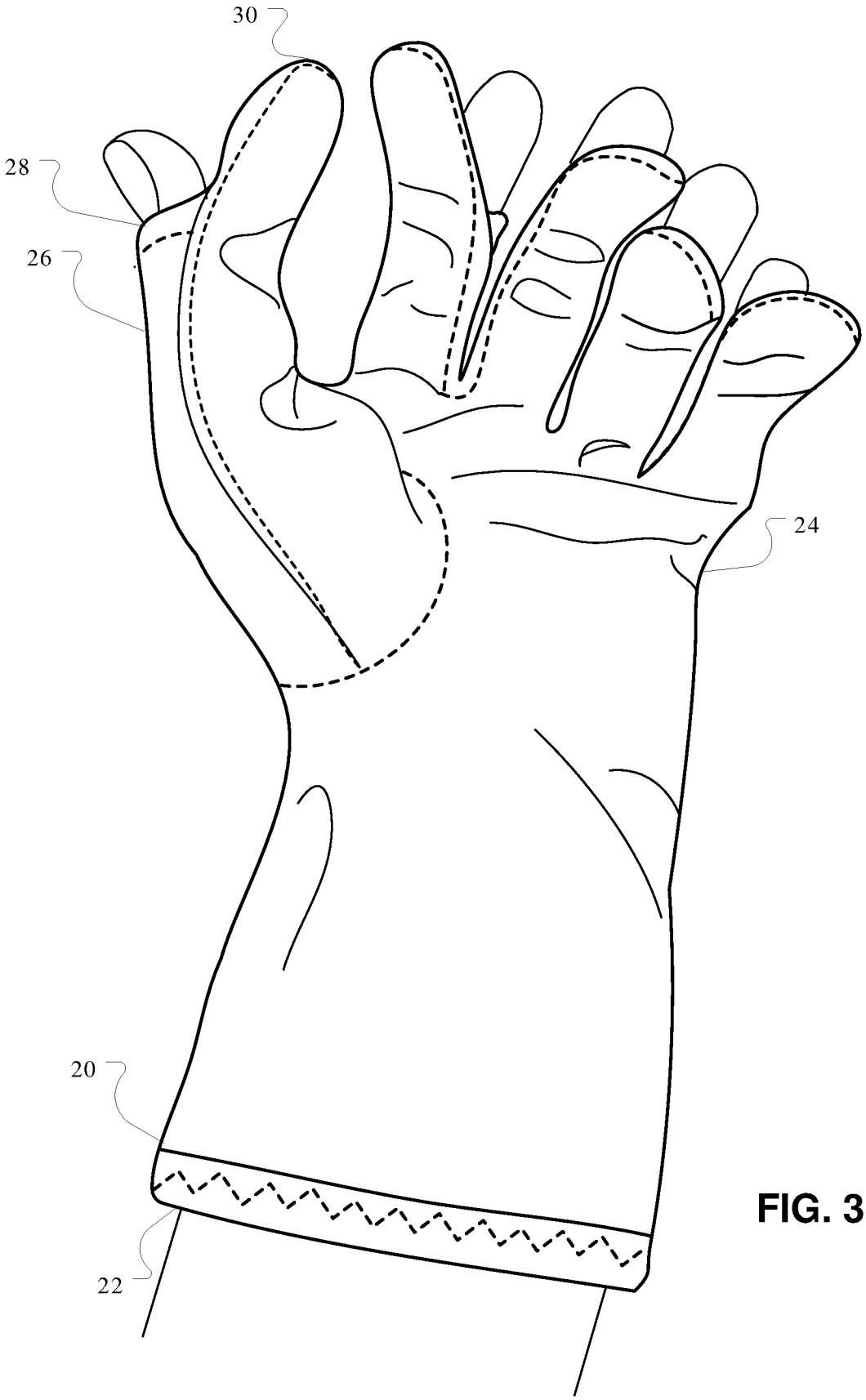
FIG. 3 shows a bottom view (palm view) of the glove embodiment of FIG. 2.

FIG. 3 shows a bottom view of the first embodiment of the glove 20. As mentioned earlier, the bottom of the glove corresponds to the user's palm. The body 24 in this view shows the palm of the glove. The protrusions 26 show an opening 28, in this case in the glove's thumb, partially defining the closed end 30 of the respective protrusion.

Figure 4:
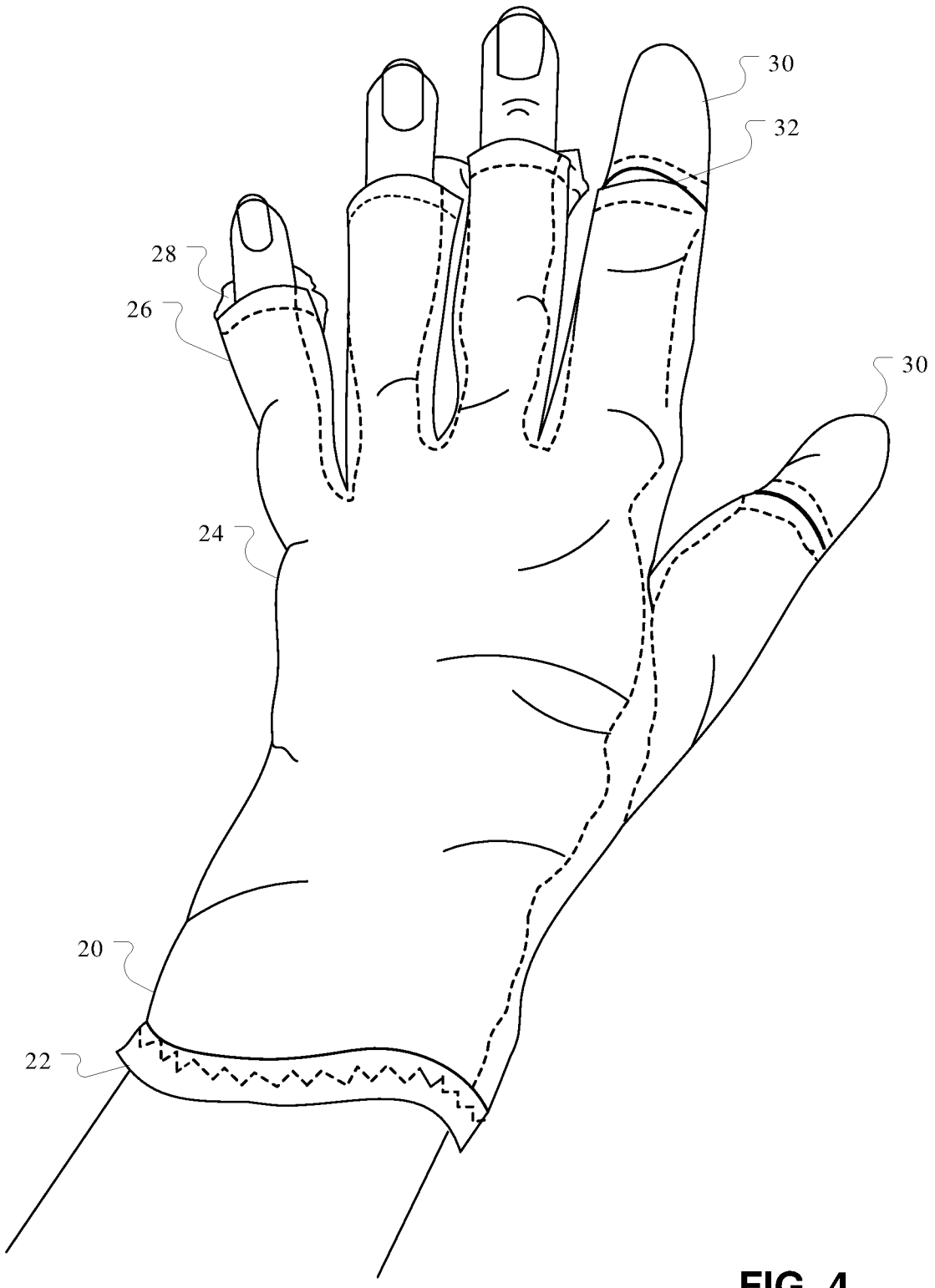
FIG. 4 shows a top view of the glove embodiment of FIG. 2 with a user's fingers partially exposed and covered.

FIG. 4 shows a top view of an embodiment of a glove 20 according to the present disclosure. When the user slides their hand into the opening 22, the body of the user's hand will be inside the body of the glove 24. The user's fingers and thumb each enter a respective protrusion 26. In this view, three of the user's fingers are exposed in the openings 28 by manipulating the respective closed end 30. The closed ends 30, when in place, have an edge 32 that covers the respective opening 28 when in a closed configuration, as seen with respect to the user's index finger.

If the user desires to perform a task that requires a better grip at the fingertip, higher levels of dexterity or access to the fingertip such as for fingerprint recognition purposes, the user can remove one or more of the closed ends 30 of the gloves from about the respective fingertip. This allows the user to use their fingers to perform tasks that the glove may otherwise prevent without requiring the removal of the glove and exposure to the moisture retained inside. Examples of these types of functions may include, but are not limited to, using a writing instrument, texting, using a tool, twisting knobs and handles, hand tightening screws or fasteners, using a cell phone and computer, etc. However, the material system composition and layer thicknesses may be selected such that a user may be able to interact with touch-activated devices such as smartphones without the need for retracting or displacing the closed ends 30.

In an alternate configuration, certain portions of the glove 20 may be comprised of one material or material system whereas other portions of the glove 20 may be comprised of a different material or material system. For example, the top surface portion of the glove body 24 covering the back of the user hand and the protrusions 26 enclosing the fingers and thumb may be comprised of the three-layer material system 10, 12, 14 shown in FIG. 1 and described in the foregoing. However, the bottom surface portion of the glove body 24 that covers the palm of the user hand may be comprised of, for example, the materials suitable for the above-described external protective layer 10 and/or the intermediate impermeable but breathable PU layer 12. The reasons for providing different materials or material systems may be attributable to a desire for greater flexibility with respect to certain portions of the glove, weight savings, and/or cost savings.

When the user has a manicure, the user can put on the gloves 24 and retract the closed ends 30 from the fingertips of the user to expose the fingernails. When the user's nails receive gel nail polish that requires curing, most of the user's hands will be protected from the heat or light used to cure the gel polish by the glove body 24 and proximal ends of the protrusions 26. Typically, the UV lights used in curing also generate a significant amount of heat. More recently, the UV lights may comprise LED lights. The gel polish still requires UV light to cure, but LED lights emit narrower UV wavelengths with higher energy and concentration. These lights do not generate as much heat. Even so, it is beneficial for the glove body and proximal ends of the protrusions to protect the user's hands from heat and light.

When the user wants to moisturize their hands, they can apply moisturizer and then put the gloves 24 on with the closed ends 30 closed in place over the respective fingertips. For manicures or for other instances where fingertip access is beneficial or required, the user can remove the closed ends 30 from about the respective fingertip. Each closed end may then be pivoted about an area of the protrusion opposite the respective opening 28. In certain applications, it may be beneficial for the closed end to remain proximate to and underneath the respective fingertip. For example, when a person extends a hand into a UV-curing light device, the bottom surface may contain germs or other undesirable substances because the light device is typically used by many customers such as in a nail salon and because the interior of such a light device may not be easily and thoroughly cleaned. By positioning each closed end directly under the respective fingertip, a barrier is provided that helps protect the fingers from coming into contact with potential germs or other undesirable substances. In other applications, it desirable for the closed ends to be pivoted such that one or more is adjacent a proximal portion of the respective protrusion, thereby remaining out of the way of the respective fingertip. Additionally, when a person extends a hand into a UV-curing light device, the top surface of the device may be uncomfortably hot. When wearing the glove, most of the hand and fingers are protected from this heat.

Figure 5:
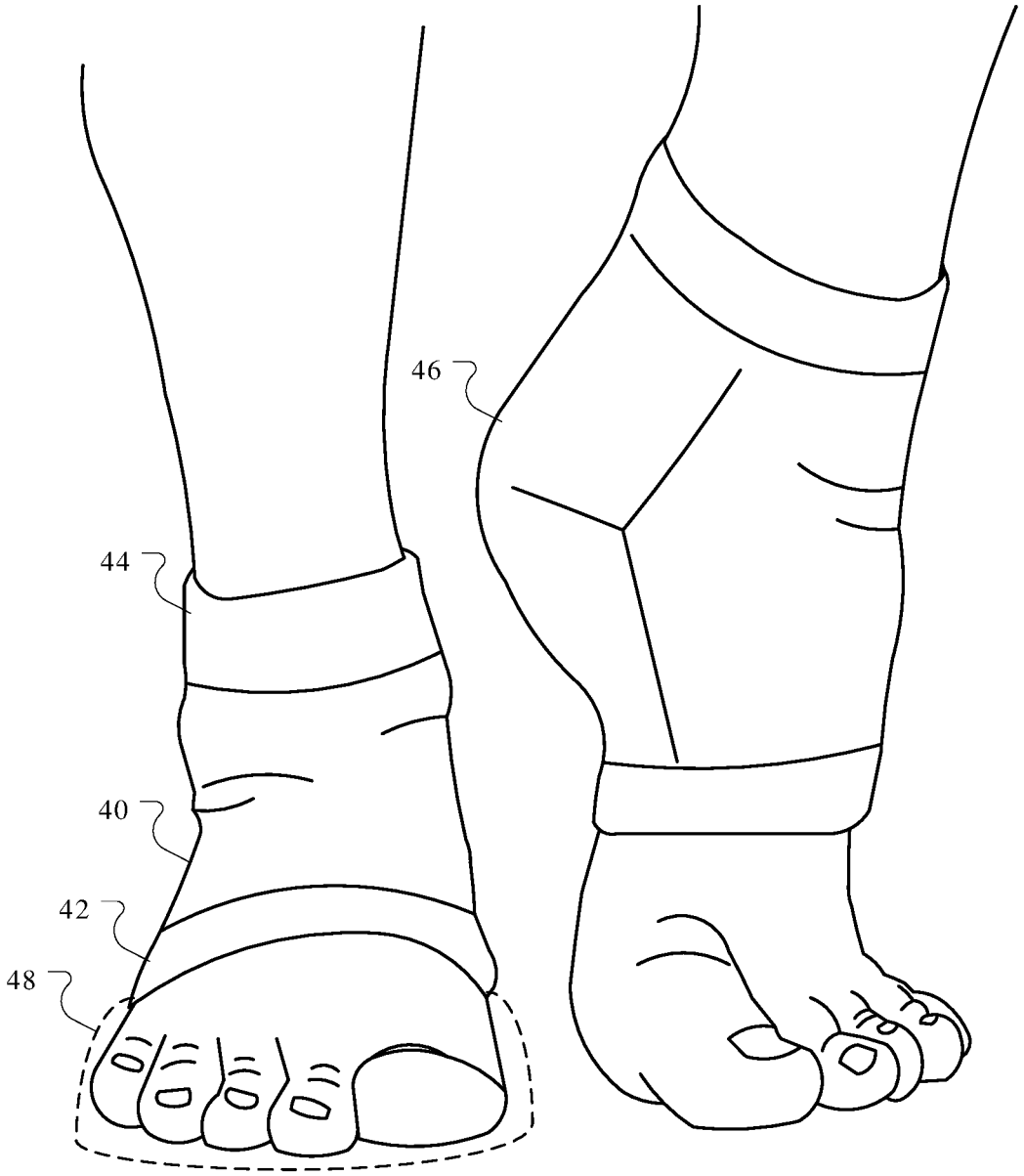
FIG. 5 shows a first embodiment of a sock made from the moisture-retaining material system of FIG. 1.

Other applications of the presently disclosed material system include wound or medical treatment wraps and socks. FIG. 5 shows a first embodiment of a sock according to the present disclosure. The sock body 40 comprises the same material system as shown in FIG. 1 and, in particular, may comprise the three-layer system shown and described with respect FIG. 1. When a user moisturizes their feet, particular emphasis is often placed on the heel of the foot. The socks have a heel portion 46 as part of the sock body. This allows the user to moisturize their heels and the disclosed material system keeps the moisturizer on the skin to facilitate absorption. The sock as shown may have a short portion 42 that extends towards the toes, but does not necessarily enclose the toes. However, other embodiments may include an entire sock, as shown in FIG. 5 by dashed line 48 toe portion. In this latter embodiment, the toe portion may comprise an opening, such as intermediate the short portion 42 and the toe portion 48, above and proximal to the toes. The toe portion 48 is then articulatable down and back towards the lower surface of the arch of the user's foot for the purpose of exposing the nails of the toes, while the remainder of the sock body remains in place for the purpose of providing thermal or mechanical protection, for providing UV protection, or both. Similarly, the upper extent 44 of the sock is shown as only an ankle-length sock, though in other embodiments the sock upper extent could be lower, commonly referred to as a 'footie' or a 'no show' sock, or higher, commonly referred to as a 'tube' sock. Another embodiment of the sock could include a VELCRO®-type or other type of fastenable closure (not illustrated) for the purpose of maintaining the articulatable toe portion 48 in place with respect to the short portion 42. Certain glove embodiments may also be provided with similar fastenable closures. The outer material for a sock, corresponding to the external protective shell layer 10 in FIG. 1, may comprise any material, such as cotton, wool, spandex, polyester, mixed materials, nylon, leather, rubber, vinyl, etc. The inner materials, corresponding the impermeable but breathable layer 12 and the fabric layer 14 of FIG. 1, will include the polyurethane membrane system mentioned above with respect to FIG. 1. The foregoing description of a sock embodiment refers to moisturizer, though it is readily appreciated that similar benefits of long exposure to medications may be achieved using the disclosed sock.

Figure 6:
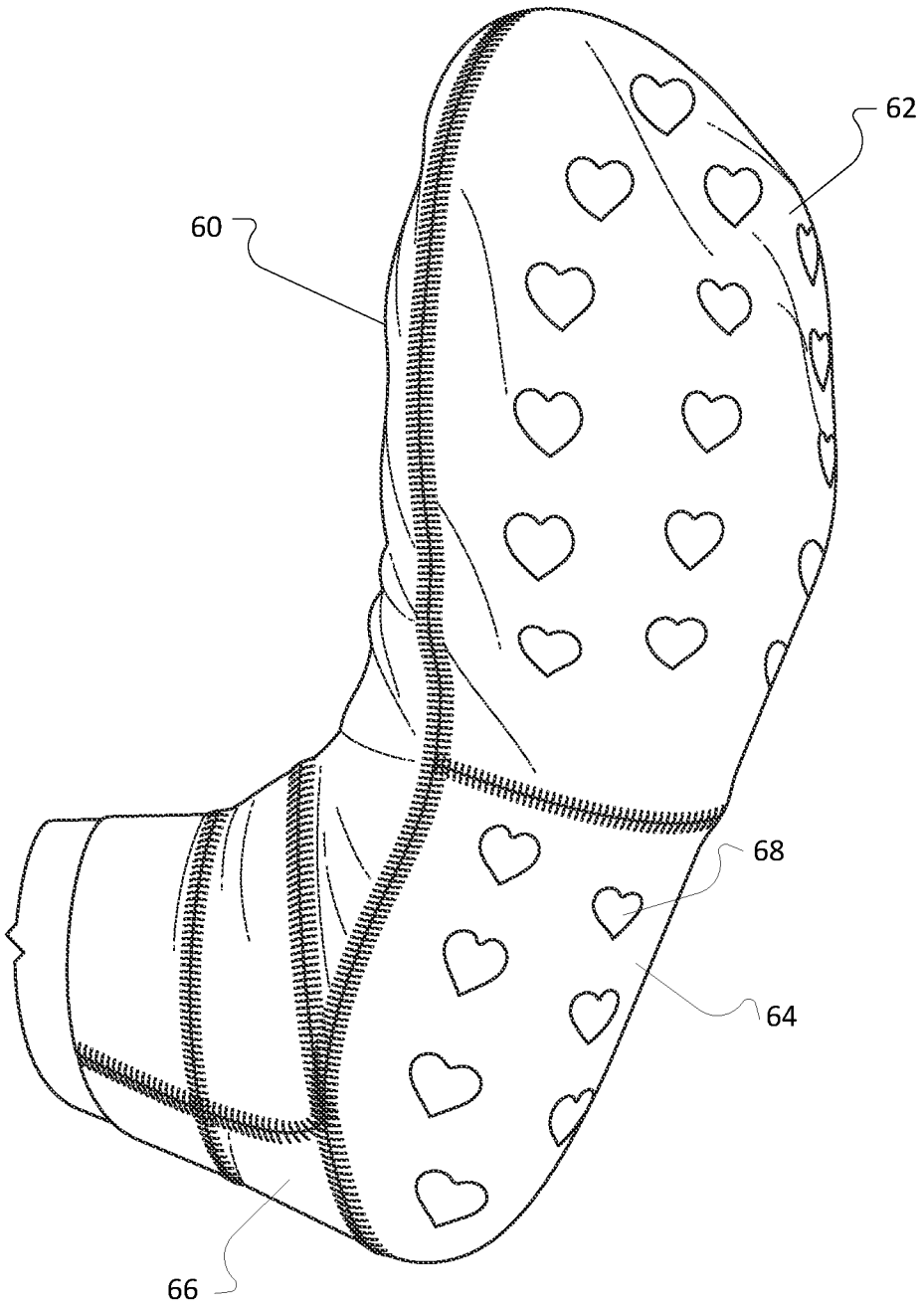
FIG. 6 shows an underside view of a second embodiment of a sock made from the moisture-retaining material system of FIG. 1.
Figure 7:
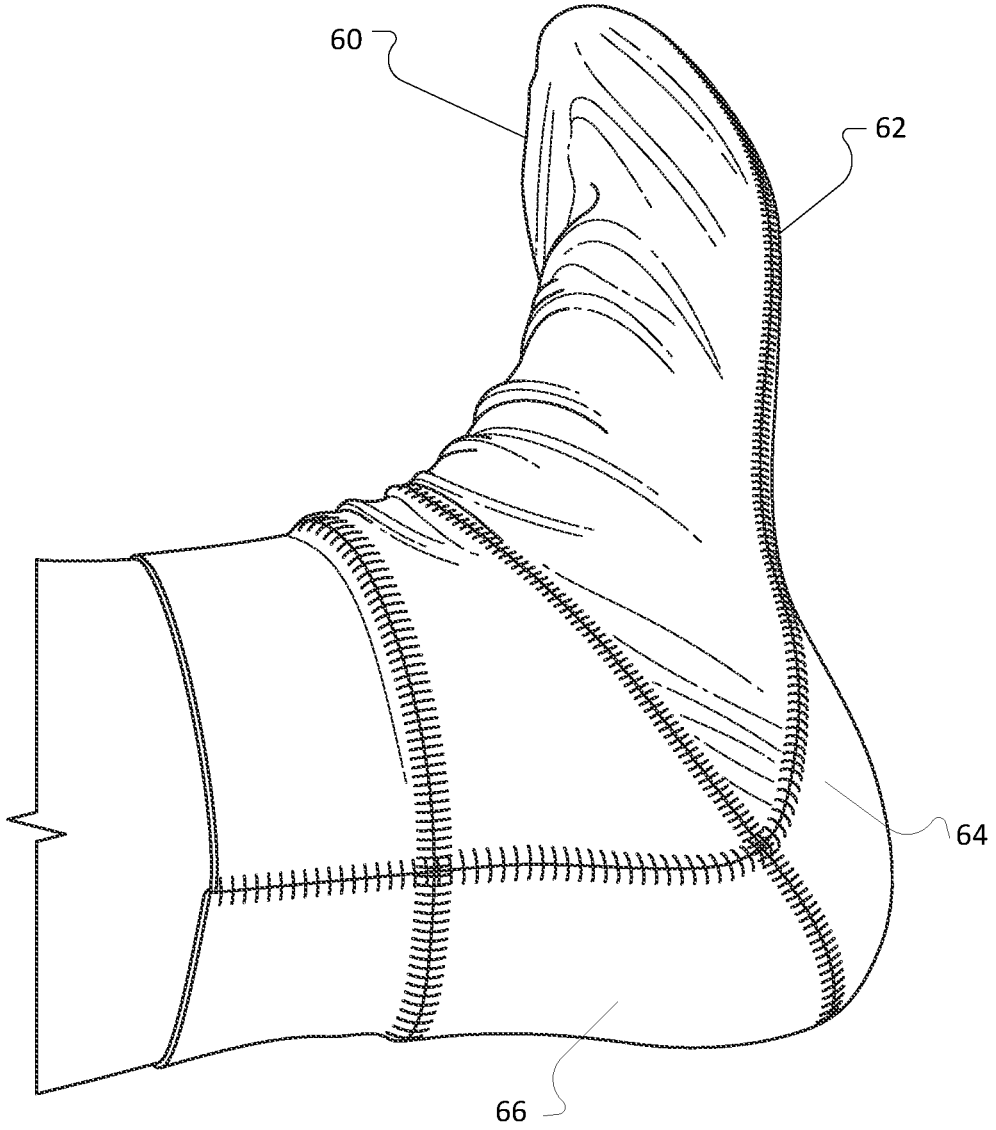
FIG. 7 shows a side view of the second embodiment of a sock of FIG. 6.

A second sock embodiment is depicted in FIGS. 6 and 7. The sock body 60 of this second embodiment is continuous and lacks the articulatable toe portion 48 of the first sock embodiment of FIG. 5. The second sock embodiment may be comprised of the same material system as described above with respect to FIG. 1. That is, all portions of the second sock embodiment may comprise an external protective layer, an intermediate impermeable but breathable layer and an internal fabric layer. To provide increased traction, various elements of higher friction 68 may be applied to the sock forefoot 62 and hindfoot 64, such as through the application of silicone appliques or transfers. These higher friction elements may be adhered to the external protective layer using conventional techniques such as heat bonding and/or adhesives.

However, in a further variation of this second embodiment, certain portions of the sock body 60 may be comprised of one material or material system while other portions of the sock body 60 may comprise another material or material system. In other words, the underside of the forefoot 62, the underside of the hindfoot 64 and the heel portion 66 may be comprised of one material or material system whereas the remaining portion of the sock body 60 may be comprised of a different material or material system. For example, the underside of the forefoot, underside of the hindfoot and heel may all be comprised of the three layer material system 18 of FIG. 1, whereas the remaining portions of the sock body 60 may be comprised of the materials described above for the external protective shell 10, the impermeable but breathable PU layer 12, or both. The reasons for providing different materials or material systems may be attributable to a desire for greater flexibility with respect to certain portions of the sock body 60, weight savings, and/or cost savings.

The material system as described with respect to FIG. 1 may further be used in the form of a fastenable wrap or cover with respect to other body parts. While not shown here, the wrap could take the form of a glove or a sock, as shown in the figures above. In wound care, the wound often requires applying medication in the form of ointment or cream. A common problem in using a medication arises with the medication inadvertently getting wiped off, absorbed by a wrapping, or otherwise removed from the wound site. Health care workers may wrap the treated wound with gauze or other materials to cover the medication, and those materials may remove some of the medicine through absorption.

Figure 8:
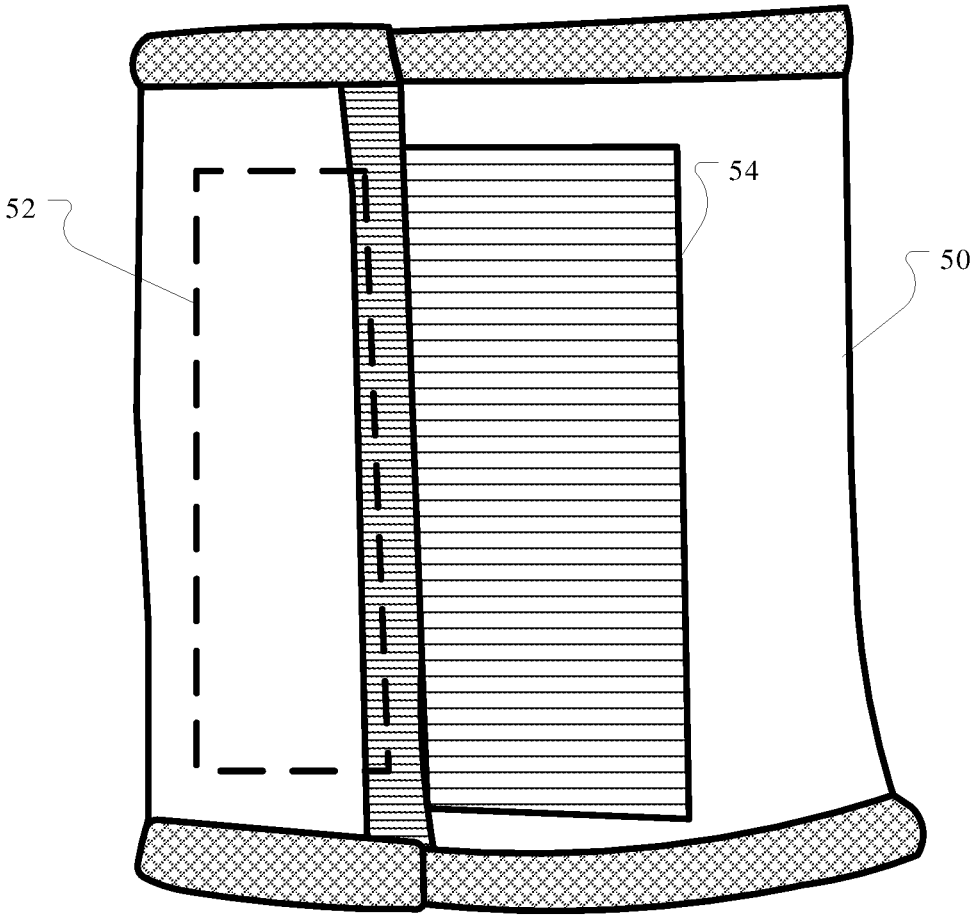
FIG. 8 shows an embodiment of a fastenable wrap made from the moisture-retaining material of FIG. 1.

FIG. 8 shows an embodiment of a selectively fastenable wrap 50. The body of the wrap may comprise the same or similar material system as shown and described with respect to FIG. 1. The wrap as illustrated is provided with a releasable fastener that allows the breathable layer 14 of the wrap to surround a body part having a wound or medical condition requiring treatment, thereby preventing medication or other liquid or viscous substance from passing through the wrap. In the embodiment of FIG. 8, the fastener may consist of a hook and loop closure, such as VELCRO®. The hook and loop closure has a first portion 54 and a second portion 52 to fasten the wrap. The dimensions and configuration of the wrap may be customized according to the intended use. For example, a wrap 50 intended to enclose a lower leg of a patient may include an upper portion having a larger internal diameter as compared to a lower portion in order to accommodate a calf muscle of a user.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings can be replaced by alternative components serving the same, equivalent, or similar purpose unless expressly stated otherwise.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art, which are also intended to be encompassed by the embodiments.

What is claimed is:

1. A glove, comprising:

a glove body having an opening configured to allow insertion of a hand of a user, a top surface for corresponding to a back of the user hand when inserted in the glove, and a bottom surface for corresponding to a palm of the user hand when inserted in the glove;

plural protrusions, each protrusion having a proximal end, a distal closed end, a top surface, and a bottom surface, each protrusion connected to the glove body at the proximal end thereof and configured for enabling the insertion of a finger or thumb of the user hand into the respective protrusion; and an opening in one of either the top surface or the bottom surface of each protrusion, positioned between the respective proximal and distal ends, the openings positioned to allow the respective closed end to be pulled off an end of the respective finger or thumb when inserted in the glove to allow access to the end of the respective finger or thumb, wherein at least a portion of the glove body and protrusions are made of a material having at least three layers, a first outer layer selected to protect the user hand from an external environment, a second hydrophobic inner fabric layer to retain moisture on the surface of the user hand, and a third intermediate impermeable and breathable layer.

2. The glove, as claimed in claim 1, wherein each opening is positioned on the top surface of the respective protrusion.

3. The glove, as claimed in claim 1, wherein each opening is positioned in an upper half of the respective protrusion proximate the respective closed end.

4. The glove, as claimed in claim 1, wherein each closed end comprises an edge that covers the respective protrusion opening when the closed end is configured to cover the finger or thumb of the user hand.

5. The glove, as claimed in claim 1, wherein the first layer is comprised of nylon, polyester and/or spandex.

6. The glove, as claimed in claim 1, wherein the first layer comprises leather, rubber, vinyl, or combinations thereof.

7. The glove, as claimed in claim 1, wherein the second layer is comprised of hydrophobic polyurethane.

8. The glove, as claimed in claim 1, wherein the third layer is comprised of hydrophobic knit fabric.

9. The glove, as claimed in claim 8, wherein the hydrophobic knit fabric is comprised of spandex blended with nylon or polyester.

10. The glove, as claimed in claim 1, wherein the top and bottom surfaces of the glove body are each comprised of dissimilar materials.

* * * * *